US007393333B2

(12) United States Patent
Stivers

(10) Patent No.: US 7,393,333 B2
(45) Date of Patent: Jul. 1, 2008

(54) ACUPRESSURE APPARATUS WITH FOOT CONTROL

(76) Inventor: Mark H. Stivers, P.O. Box 6363, Tyler, TX (US) 75711

( * ) Notice: Subject to any disclaimer, the term of this patent is extended or adjusted under 35 U.S.C. 154(b) by 479 days.

(21) Appl. No.: 11/057,586

(22) Filed: Feb. 14, 2005

(65) Prior Publication Data

US 2006/0089579 A1 Apr. 27, 2006

Related U.S. Application Data

(60) Provisional application No. 60/621,583, filed on Oct. 22, 2004.

(51) Int. Cl.
*A61H 39/04* (2006.01)

(52) U.S. Cl. ..... 601/133; 601/134; 601/89; 606/204

(58) Field of Classification Search ..... 601/133–136, 601/90, 97, 98, 89; 606/206, 210, 204, 207, 606/201; 81/427, 418, 426.5, 424.5, 3.7, 81/419

See application file for complete search history.

(56) References Cited

U.S. PATENT DOCUMENTS 1,281,487 A * 10/1918 Beshgeturian ..... 601/133
3,595,225 A * 7/1971 Beeman ..... 602/21
4,549,536 A * 10/1985 Varjabedian ..... 601/135
5,094,227 A * 3/1992 Eglauf et al. ..... 601/135
5,282,634 A * 2/1994 Chamberland ..... 473/510
5,405,311 A * 4/1995 Pecora et al. ..... 601/135
5,484,390 A * 1/1996 Chiang ..... 601/133
5,709,647 A * 1/1998 Ferber ..... 601/134
6,167,602 B1 * 1/2001 Yang et al. ..... 29/278
7,101,345 B1 * 9/2006 Liu ..... 601/133
2003/0233119 A1 * 12/2003 Tiedemann ..... 606/210

* cited by examiner

*Primary Examiner*—Danton DeMille
(74) *Attorney, Agent, or Firm*—Ronald B. Sefrna

(57) ABSTRACT

An acupressure apparatus for applying pressure to the LI4 acupressure points on both of a user's hands simultaneously includes a pressure applicator assembly with an upper plate and a lower plate overlying each other and pivotally connected at one aligned edge, each plate having a pair of knobs with the respective upper and lower knobs aligned to come together and apply pressure to a user's hand placed between them. In a first embodiment the upper plate of the pressure applicator assembly is connected to a footplate by a flexible cable so that a user may hold the pressure applicator assembly in his or her hands, place his or her feet on the footplate with the lower plate of the pressure applicator assembly on his or her knees, and apply pressure to the hands by raising his or her knees to bring the lower plate and knobs upward against the upper plate and knobs. In a second embodiment a cable assembly with an outer tube and an inner wire is connected between the pressure applicator assembly and a foot pedal assembly so that depression of the foot pedal while a user holds the pressure applicator assembly brings the plates and knobs together to apply pressure to the user's hands.

17 Claims, 8 Drawing Sheets

ACUPRESSURE APPARATUS WITH FOOT CONTROL

RELATED APPLICATION DATA

This application claims the priority of U.S. Provisional Patent Application Ser. No. 60/621,583, filed Oct. 22, 2004, and titled "Acupressure Apparatus With Foot Control".

FIELD OF THE INVENTION

The present invention generally relates to the field of acupressure devices and apparatus, and in its preferred embodiments more specifically relates to apparatus for applying pressure controlled by the user to, especially, the LI4 acupressure points of both hands simultaneously.

BACKGROUND

Although it is not well understood, it is recognized that acupressure is an effective technique for relieving pain and discomfort. For example, it is known that the application of controlled pressure to what are referred to as the LI4 points of the hands, located in the fleshy area between the thumb and forefinger of each hand, can be very effective in relieving headaches, as well as earaches and toothaches. The appropriate amount of pressure and the exact location of the points to which pressure is applied for most effective treatment varies from person to person. Although relief can be achieved through the application of pressure to one hand at a time, it has been found to be much more effective to apply pressure to both hands simultaneously. It can also be effective to vary the amount of pressure applied during a treatment session, rather than continuously maintaining the same pressure.

Often, pressure is applied to one person's hands by another person. Unfortunately, a second person is not always available to perform this service. Although a person can use one of his or her hands to apply pressure to the other hand, this approach is less effective for several reasons, including the fact that pressure can be applied to only one hand at a time.

Several types of devices intended for applying pressure to the LI4 acupressure point are known in the prior art. In one approach a glove-like device is used to elastically hold and press relatively hard projections against the hand from both sides. The primary disadvantages of this approach include difficulty in adjusting the placement of the device for proper alignment of the projections, and difficulty in controlling the pressure that is applied. In another approach a clamp-like device is used to hold projections against the hand, and the amount of pressure applied is increased or decreased with a threaded screw arrangement. This type of device can be cumbersome or difficult to move around on the hand to find the appropriate point for the application of pressure, and adjusting the amount of pressure with the threaded screw requires a user to frequently move the threaded screw with the other hand. This type of device cannot effectively be used on both hands simultaneously, since it is difficult, if not impossible, to place and adjust a second device using the hand to which a first device has already been applied.

There remains an unfilled need for an acupressure device that allows a single person to apply selected and adjustable pressure to the LI4 acupressure points of both of his or her own hands simultaneously.

SUMMARY OF THE INVENTION

The present invention provides an apparatus that allows a person to easily apply acupressure to the LI4 points of both hands simultaneously, or to one hand at a time if desired, to easily adjust the point or points on a hand or hands to which pressure is applied, to easily control the initiation and release of pressure, and to control the amount of pressure applied, thus overcoming the disadvantages and drawbacks of "self-use" acupressure devices known in the prior art.

The apparatus of the invention includes a pressure applicator assembly with an upper plate and a lower plate, pivotally connected along one set of edges with a hinge and spring biased toward an open position. Each plate includes two arms that extend outwardly from the edges of the plates opposite the hinged edges, and each arm includes a knob near its outer end for the purpose of applying pressure to the user's hands. In a first embodiment of the apparatus a cable extends from the upper plate to a foot plate. The footplate is placed on the floor and the user's feet are positioned on the footplate to hold it against the floor. The pressure applicator is held in the user's hands with the knobs positioned above and below the LI4 acupoints on the user's hands, with the lower plate of the pressure applicator assembly resting upon the user's knees and the cable relatively taut between the pressure applicator and the foot plate. The user flexes his or her feet to raise the knees, the lower plate of the pressure applicator assembly is raised toward the upper plate, bringing the knobs toward each other and applying pressure to the user's hands.

In a second embodiment the single cable of the first embodiment is replaced with a double, concentric cable, with the inner cable connected to the upper plate of the pressure applicator assembly and the outer cable connected to the lower plate of the pressure applicator assembly. A foot pedal assembly is used to pull the inner cable relative to the outer cable, pulling the upper plate of the pressure applicator assembly toward the lower plate and applying pressure to the user's hands.

The structure and features of the apparatus of the invention will be described in more detail with reference to the accompanying drawing figures.

DESCRIPTION OF THE INVENTION

Figure 1:
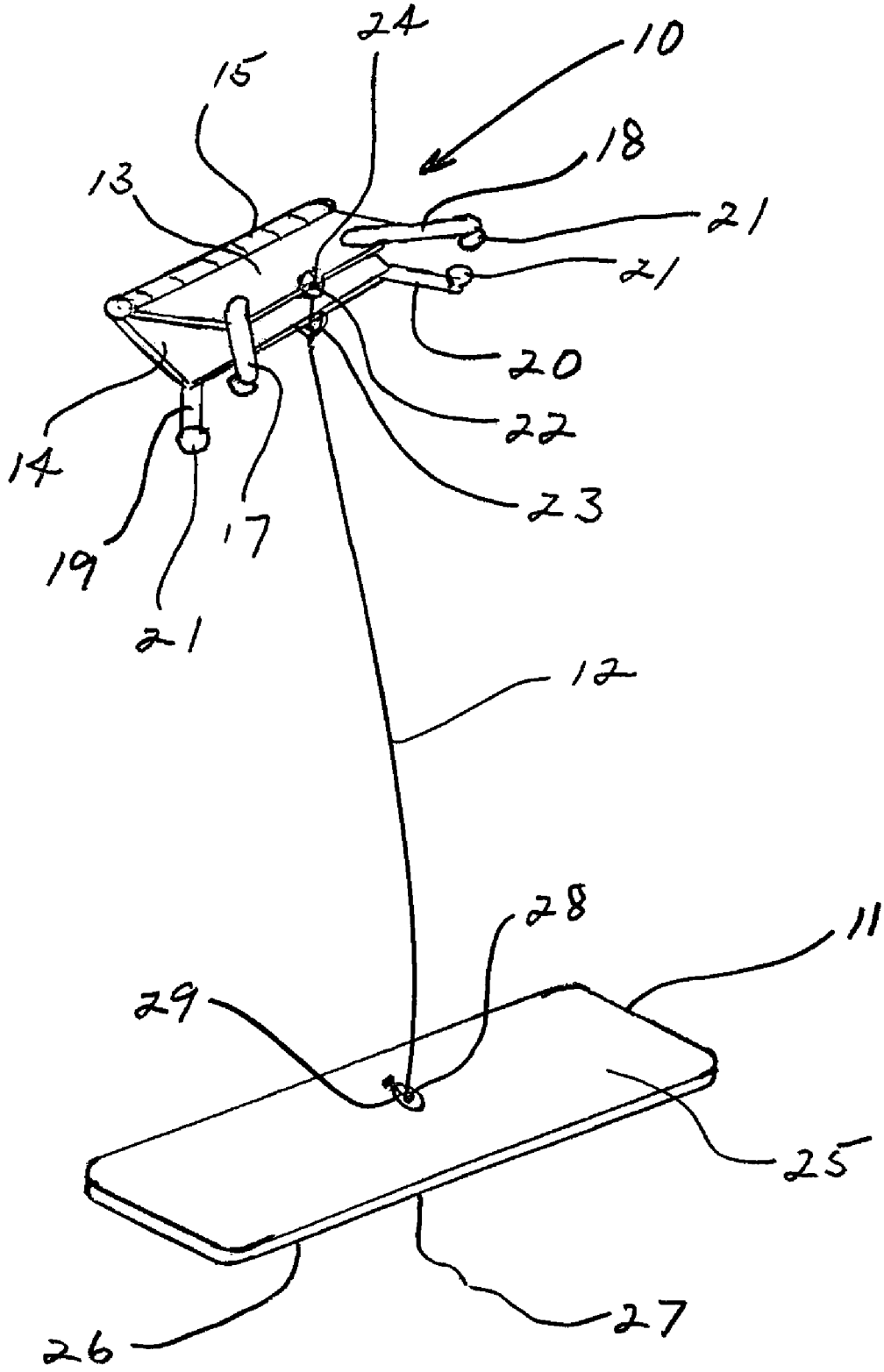
FIG. 1 is a perspective view of a preferred embodiment of the apparatus of the invention, showing the arrangement and interconnection of the components.
Figure 2:
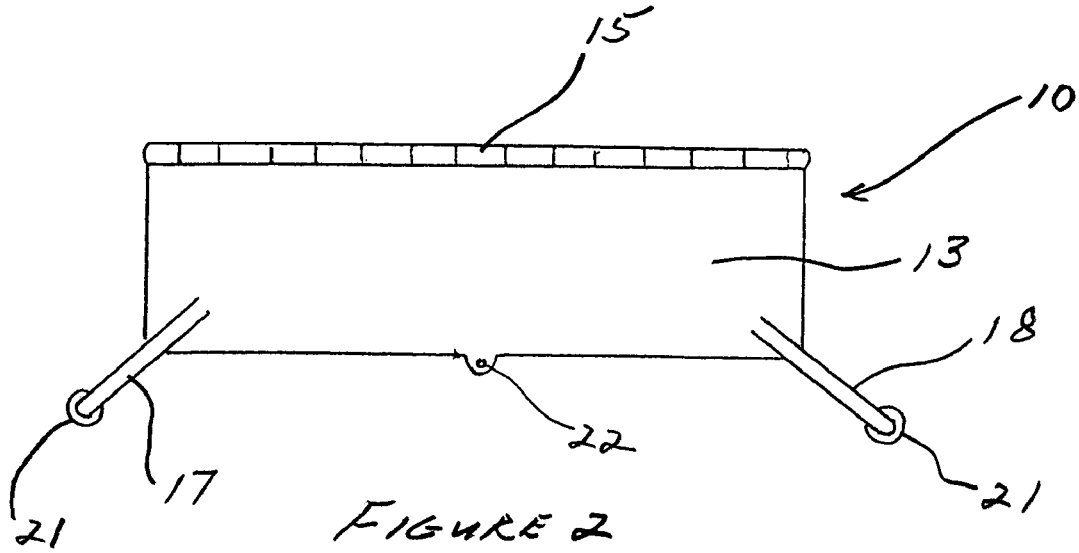
FIG. 2 is a top plan view of the pressure applicator assembly component of the first embodiment of the apparatus of the invention.
Figure 3:
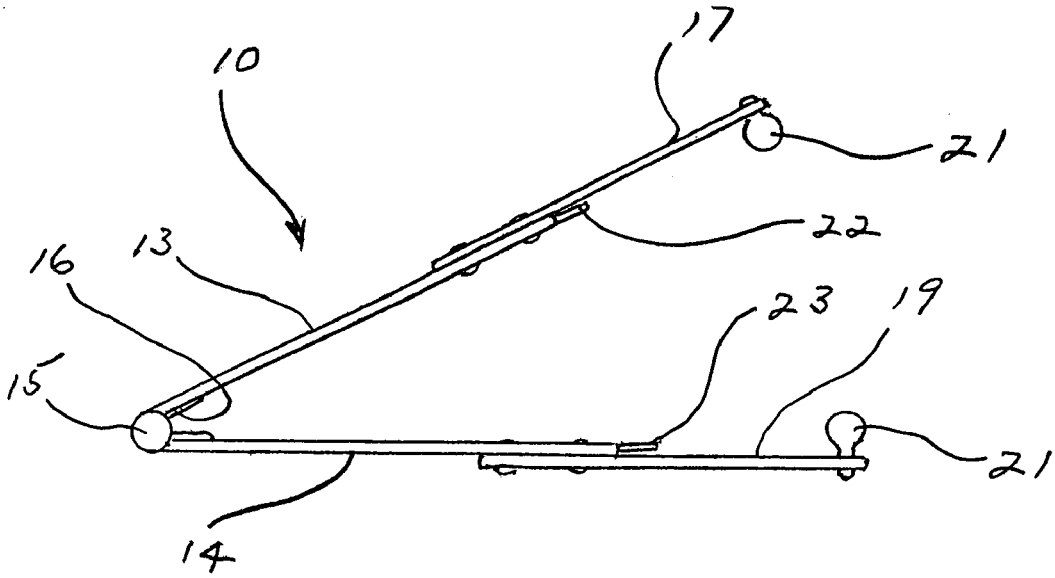
FIG. 3 is a side elevation view of the pressure applicator assembly component of the first embodiment of the apparatus of the invention.
Figure 4:
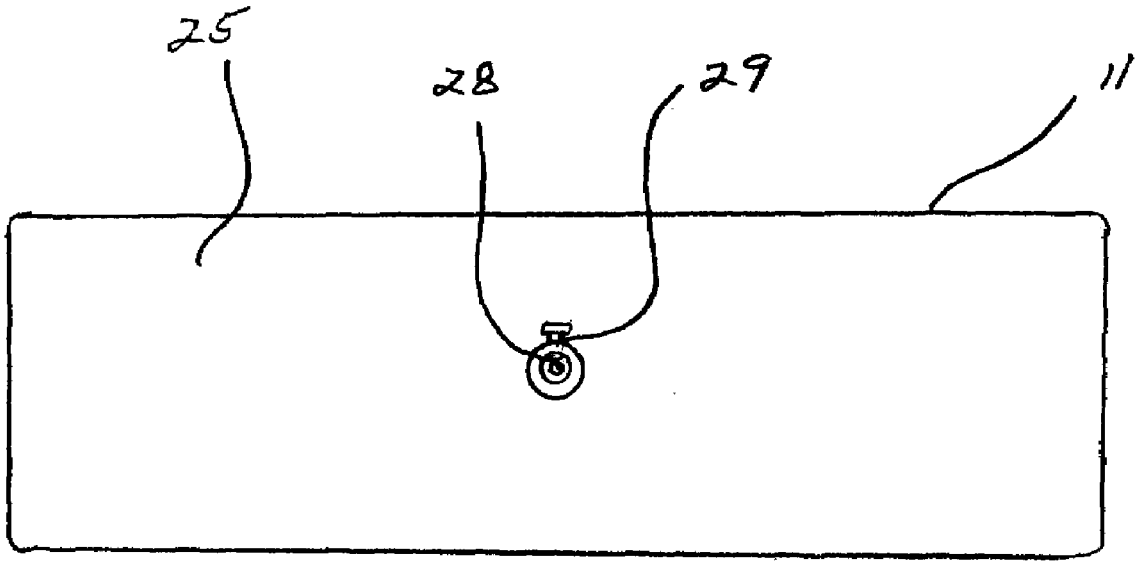
FIG. 4 is a top plan view of the footplate component of the first embodiment of the apparatus of the invention.
Figure 5:
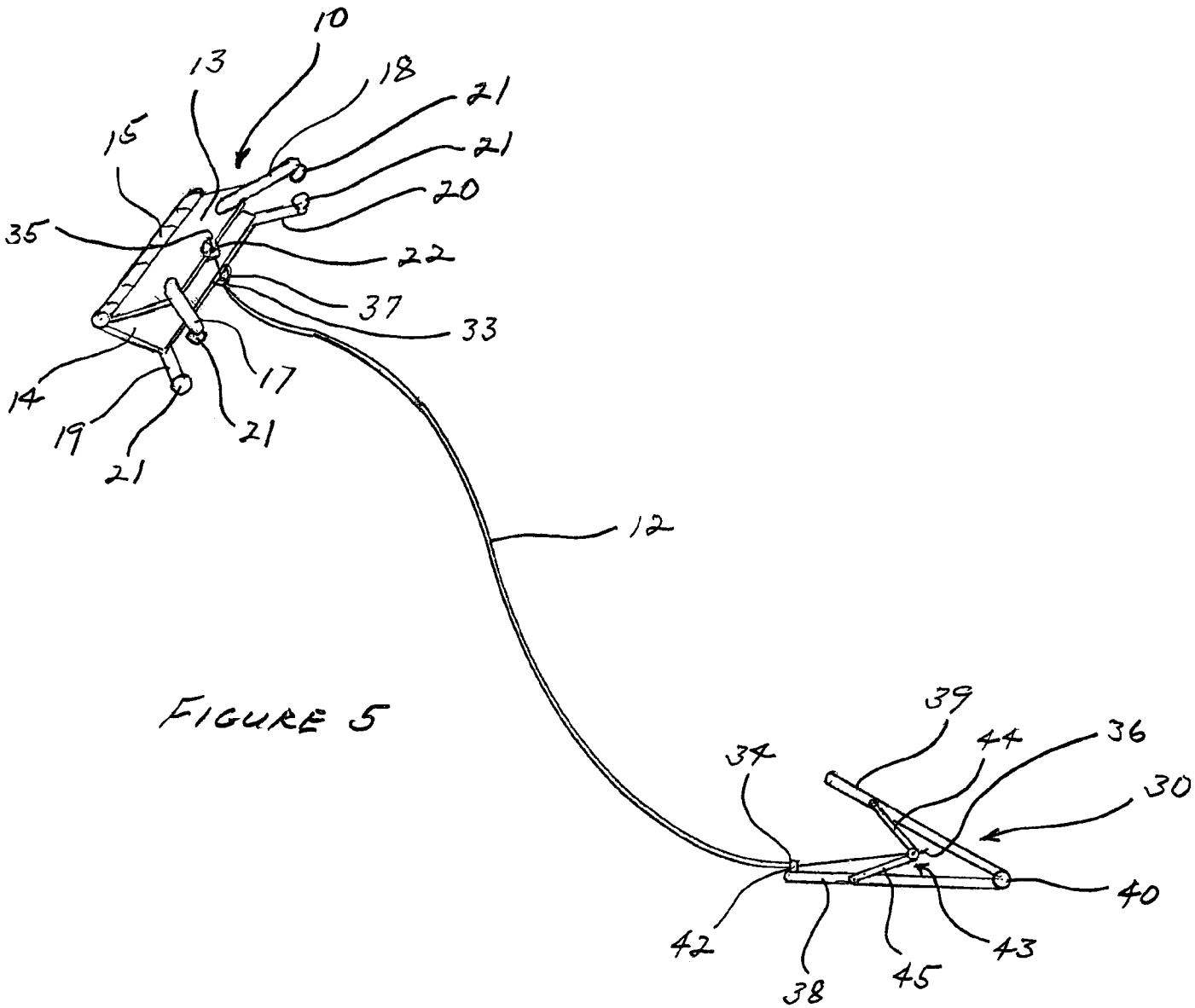
FIG. 5 is a perspective view of a second embodiment of the apparatus of the invention, using a foot pedal control.
Figure 6:
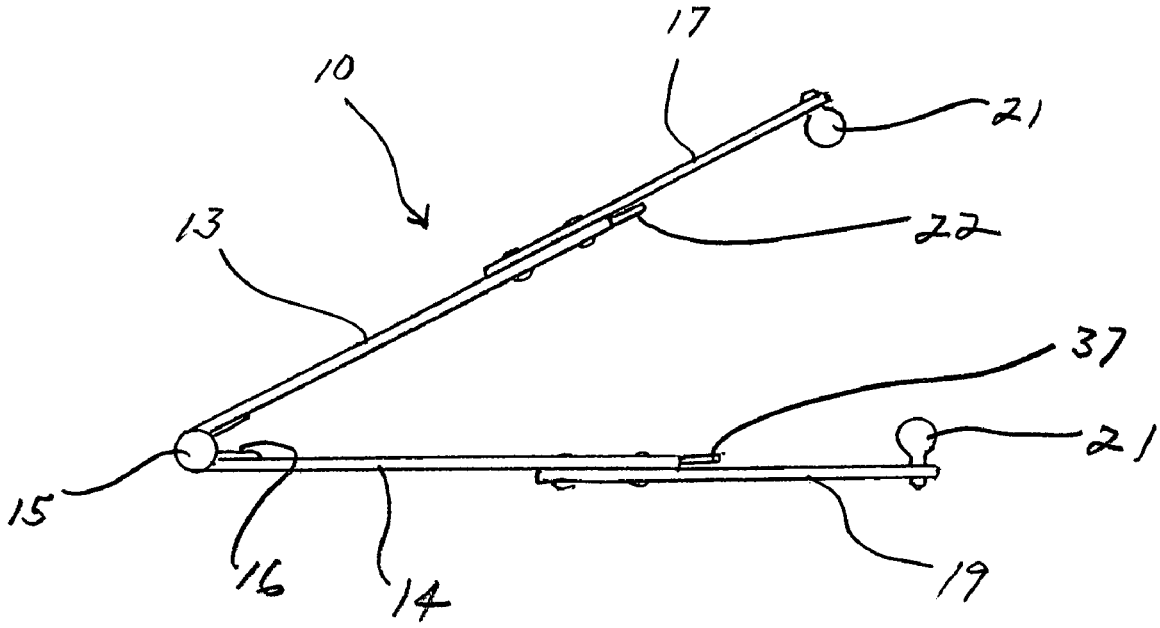
FIG. 6 is a side elevation view of the pressure applicator assembly component of the second embodiment of the apparatus of the invention.
Figure 7:
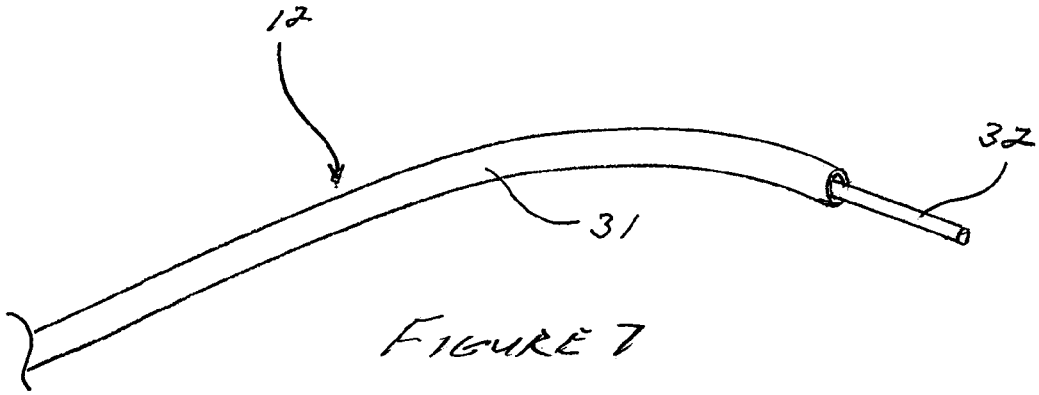
FIG. 7 is a side view of one end of the control cable component of the second embodiment of the apparatus of the invention.
Figure 8:
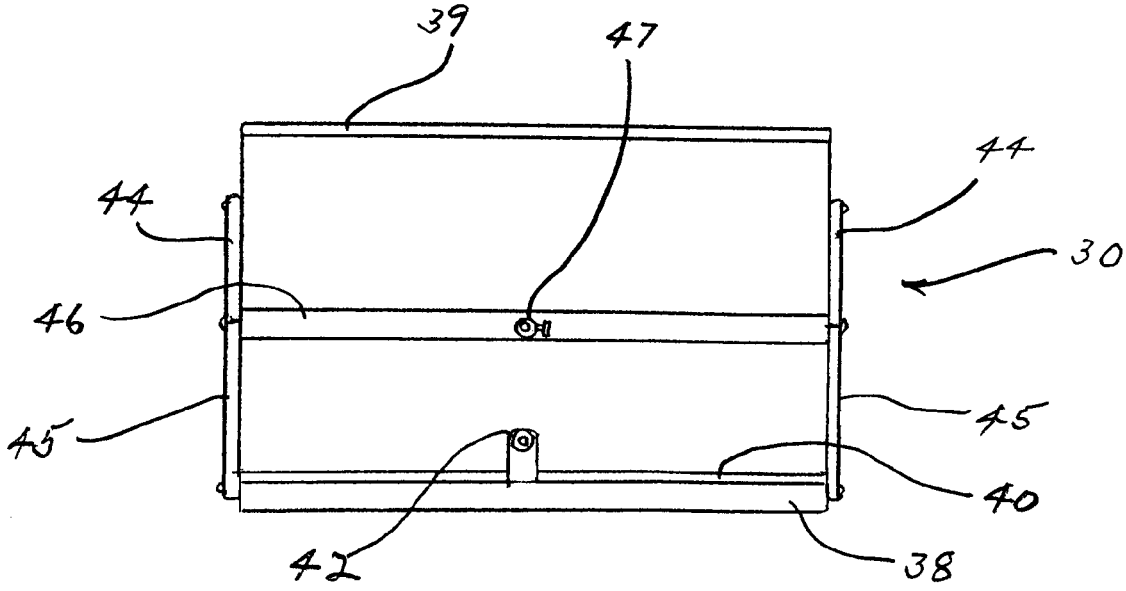
FIG. 8 is a front elevation view of the foot pedal assembly component of the second embodiment of the apparatus of the invention.
Figure 9:
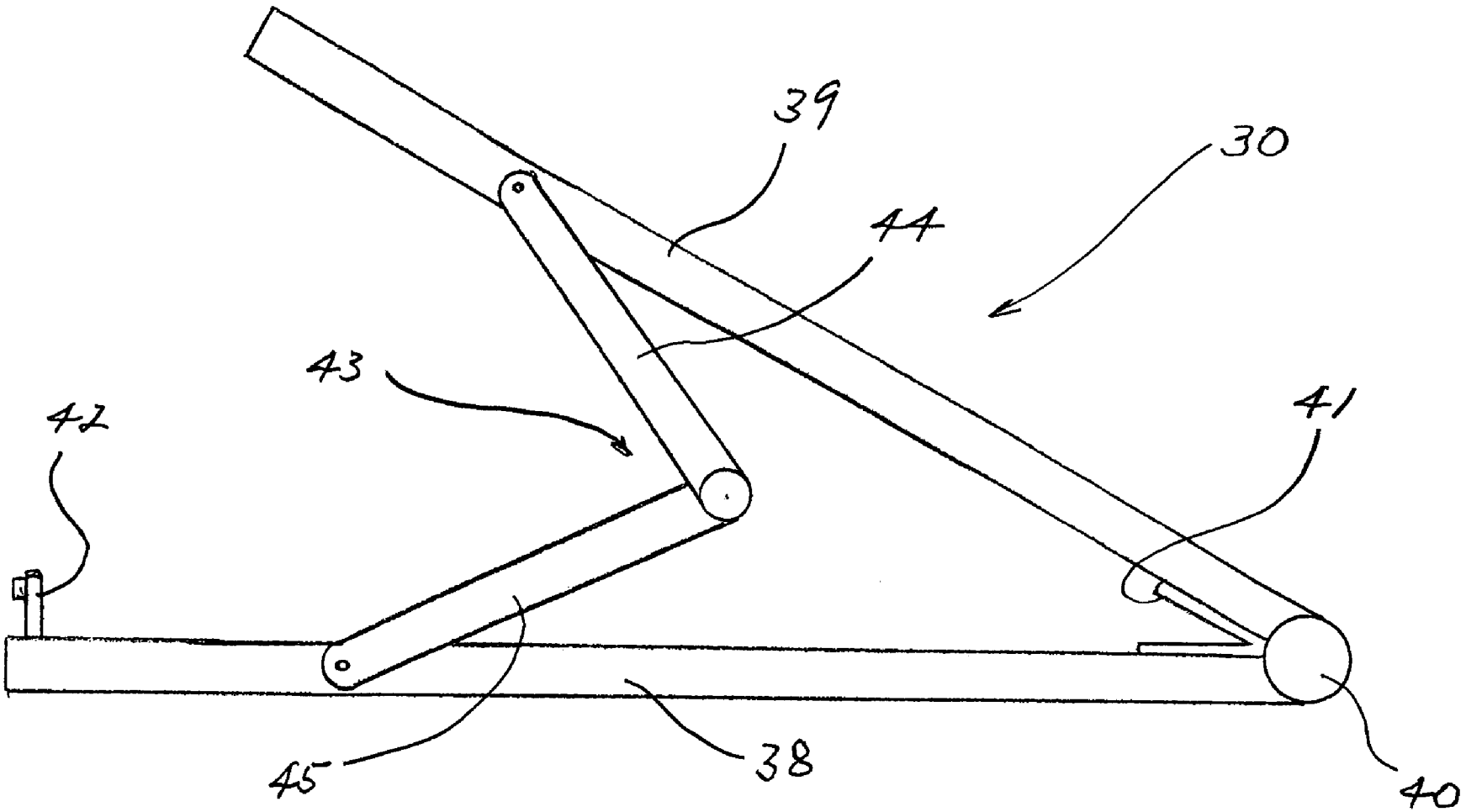
FIG. 9 is a side elevation view of the foot pedal assembly component of the second embodiment of the apparatus of the invention.
Figure 10:
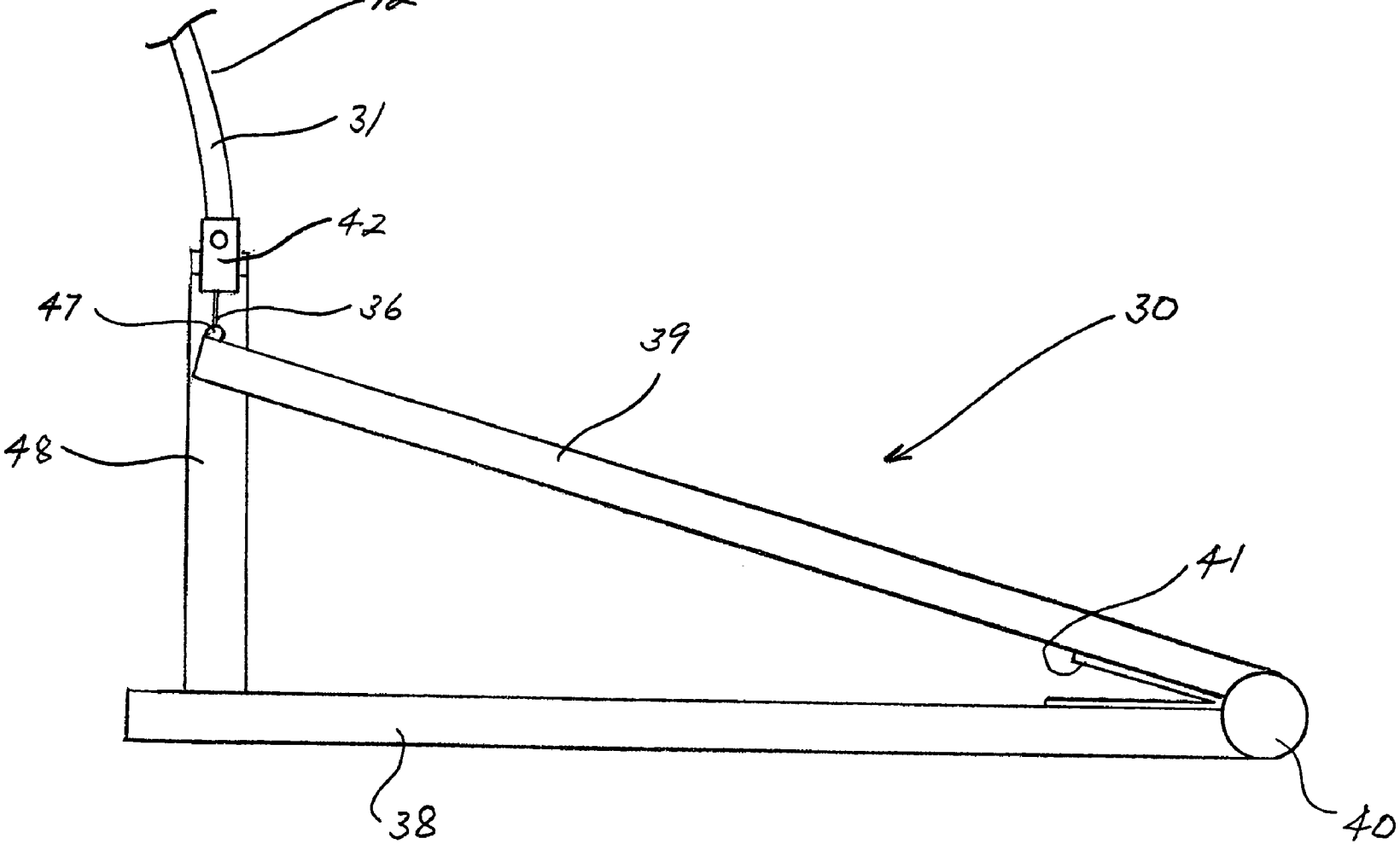
FIG. 10 is a side elevation view of an alternative embodiment of the foot pedal assembly of the second embodiment of the apparatus of the invention.

The apparatus of the first embodiment of the invention generally includes a pressure applicator assembly 10, a footplate 11, and a cable 12 connected between the pressure applicator assembly and the footplate.

In the preferred embodiments, the pressure applicator assembly includes an upper plate 13 and a lower plate 14, disposed in generally overlying relation and pivotally connected to each other along aligned edges with a hinge 15. In this embodiment plates 13 and 14 are generally rectangular and are pivotally connected along one of the long edges of each plate. It is preferred that hinge 15 be a spring hinge with an internal spring 16 to bias the plates away from each other around the pivot formed by hinge 15. The plates may be pressed together against the spring bias to bring their inner, facing, surfaces toward each other, and then pivot away from each other around their hinged connection when released.

Each of the upper and lower plates includes a pair of arms extending outwardly from the plate opposite hinge 15. In the preferred embodiment each arm extends from or over an outer corner of the plate formed by the intersection of the free long edge and one of the short edges of the plate. In the drawing figures the arms extending from the upper plate are identified by reference numbers 17 and 18, and the arms extending from the lower plate are identified by numbers 19 and 20. The arms are disposed so that arm 17 is aligned with arm 19 and arm 18 is aligned with arm 20 when plates 13 and 14 and the respective arms are pivoted toward each other around hinge 15. A projection or knob 21 is connected to the outer end of each arm, each knob extending generally perpendicular to the longitudinal axis of the arm to which it is connected. Knobs 21 are disposed so that the knobs connected to arms 17 and 19 face each other and the knobs connected to arms 18 and 20 face each other, and so that the facing knobs are brought into contact with each other when the plates and arms are pivoted together. In the preferred embodiment of the invention the outer, facing, ends of knobs 21 are smoothly rounded, although the specific configuration is not critical to the scope of the invention and any effective configuration may be used.

It is preferred that each of the upper and lower plates, and the arms and knobs associated with each plate, respectively, be integrally formed as a one piece construction of a plastic material, but it is to be understood that the scope of the invention is not limited to the use of any particular material of construction. Any other suitable material of construction, such as but not limited to metal, or a combination of materials, may be used if desired. The material of construction selected should be such that each plate and associated arms remains relatively rigid during use and does not deform to any significant degree from a generally planar configuration.

In general, the size and configuration of the pressure applicator assembly is designed so that the assembly may be comfortably held with both hands, with the opposed set of knobs 21 lying above and below the LI4 acupressure point of the respective hand. It will be understood that the specific configuration of the components of the pressure applicator assembly can be varied from the configuration shown and described, so long as the assembly can be comfortably held and the knobs correctly positioned relative to those acupressure points.

Upper plate 13 also includes a cable connector 22, disposed on the long edge of the plate opposite hinge 15 or extending slightly outward from that edge, between and generally equidistant between arms 17 and 18. It is preferred that lower plate 14 include a cable guide 23, similarly disposed on lower plate 14.

Cable 12 of the first embodiment is an elongate cable, wire, or cord that is laterally flexible but non-elastic, so that the cable does not extend in length, at least to any significant degree, when pulled. Cable 12 also has sufficient tensile strength to resist breakage under any normal conditions of use, as described below. Cable 12 may be formed of any desired material with the required characteristics, including but not limited to a stranded metallic cable, a single wire, nylon filament, other plastic filament, stranded nylon cord, any other synthetic fiber cord, or cotton cord. Cable 12 is connected at its first end 24 to cable connector 22 of upper plate 13, and extends through cable guide 23 of lower plate 14. Cable guide 23 may be omitted, if desired, and cable 12 allowed to extend past the outer edge of lower plate 14 without restraint, but the inclusion of cable guide 23 is preferred to assist in maintaining the components of the apparatus in proper orientation.

Footplate 11 is formed as a generally planar body, preferably of generally rectangular configuration, with an upper face 25 and a lower face 26. Although the footplate is generally rectangular in the preferred embodiment of the invention, it is to be understood that other configurations, such as oval or circular, may be used within the scope of the invention, if desired. Footplate 11 should be of sufficient size to allow a user to place the balls of his or her feet on the upper face of the footplate. Second end 27 of cable 12 is connected to footplate 11, preferably by extending the second end of cable 12 through an aperture 28 in footplate 11 and through a cable clamp 29, which is preferably also disposed in aperture 28. Cable clamp 29 releasably secures cable 12, between ends 24 and 27, to allow a user of the apparatus to adjust the length of the portion of cable 12 extending between pressure applicator assembly 10 and footplate 11. A variety of clamping means are known in the art and are suitable for use within the scope of the invention, which is not limited to any particular clamping means. It is preferred that cable clamp 29 be of a spring actuated type, for ease of operation, but other types of clamp means, such as a screw type clamp, may be used if desired. An independent clamp, free of connection to footplate 11 may also be used if desired. In that approach the independent clamp is disposed on cable 12 after the cable has been extended through aperture 28, and is of larger dimension than aperture 28, so that the clamp will not pass through the aperture and will maintain the length of cable 12 extending between pressure applicator assembly 10 and footplate 11.

To use the first embodiment of the apparatus described above, a user assumes a comfortable seated position and places the footplate on the floor in front of the user so that he or she can comfortably position the balls of his or her feet on the footplate. The length of cable 12 extending between the footplate and the pressure applicator assembly is adjusted so that lower plate 14 of the pressure applicator assembly rests upon the user's knees, with the user's feet flat on the floor and cable 12 relatively taut. The user positions his or her hands between the upper and lower plates of the pressure applicator assembly with knobs 21 positioned above and below the acupressure points of the user's hands. To apply pressure to the acupressure points the user raises his or her heels from the floor, in a motion known a plantar flexion, raising his or her knees and pressing lower plate 14 toward upper plate 13, which is constrained by cord 12 extending between the upper plate and the footplate. The user may easily determine, and vary, the pressure applied to the hands by changing the force with which his or her knees are raised. A user may also grasp the lower plate while holding the pressure applicator assembly in his or her hands and lift upward on the lower plate with his or her hands, raising the lower plate while the upper plate is restrained by the cable, thereby bringing the knobs together to apply pressure to both the user's hands. If a user wishes to apply pressure to one hand at a time, the other hand may, of course, be used to squeeze the upper and lower plates together to apply pressure to the selected hand.

In a second embodiment of the invention a foot pedal assembly 30 is used instead of footplate 11, so that a user may hold the pressure applicator assembly 10 in his or her hands without necessarily resting the assembly on the knees, and apply pressure to the hands by depressing the foot pedal assembly. In this embodiment cable 12 is a two component cable assembly including an elongate hollow flexible guide tube 31 and an elongate wire 32 extending through the interior of tube 31. Tube 31 has first and second ends 33 and 34, and wire 32 has first and second ends 35 and 36. The first and second ends of wire 32 extend outwardly beyond the first and second ends, respectively, of tube 31. The cross-sectional dimension of wire 32 is slightly smaller than the cross-sectional dimension of the interior of tube 31, so that wire 32 may be freely moved longitudinally in the interior of tube 31. Tube 31 and wire 32 are preferably formed of metal, but it is to be understood that plastics or other materials of construction may be used within the scope of the invention so long as the described functions of the control cable assembly are achieved.

In the apparatus of the invention the first end of wire 32 is connected to cable connector 22, on upper plate 13 of the pressure applicator assembly, and the first end of tube 31 is connected to a second cable connector 37, which replaces cable guide 23 on lower plate 14. Because wire 32 may be moved within the interior of tube 31, when the second end of wire 32 is pulled outwardly from the second end of tube 31 while the second end of the tube is held in a fixed position, upper plate 13 is pulled toward lower plate 14 against the spring bias. When the pulling force on the second end of wire 32 is released, the spring force causes plates 13 and 14 to separate, pulling wire 32 in the opposite direction through tube 31. In this embodiment of the apparatus of the invention, foot pedal assembly 30 functions to hold the second end of tube 31 and to impose and release the pulling force on the second end of wire 32.

Foot pedal assembly 30 includes abase 38 to rest upon a floor or other generally flat surface. Base 38 is preferably generally rectangular in configuration, of sufficient length and width to provide stability to the foot pedal assembly during operation. A foot pedal 39, also generally of rectangular configuration in the preferred embodiment, is pivotally connected at one end to one end of base 38 through hinge 40. A biasing means, such as a spring 41, is used to provide a biasing force tending to cause the foot pedal to rotate away from the base around hinge 40. The biasing means may be integral with hinge 40 or separate spring(s) or other means may be used within the scope of the invention. The second end 34 of tube 31 is secured in a fixed position on the foot pedal assembly and the second end 36 of wire 32 is connected to move relative to tube 31 when foot pedal 39 is moved. When the foot pedal is depressed, wire 32 is pulled through tube 31, moving the plates of the pressure applicator assembly toward each other and applying pressure to the user's hands through knobs 21. It is to be understood that a variety of foot pedal designs may be devised and used within the scope of the invention to perform this function.

In a preferred embodiment of the foot pedal assembly generally described above, a third cable connector 42 is disposed on base 38 at or near the end opposite hinge 40, to receive and secure the second end of tube 31. A scissor assembly 43 is connected between the base and the foot pedal of the foot pedal assembly, and functions to pull and release the second end of wire 32. In the preferred embodiment scissor assembly 43 includes a pair of upper arms 44, each pivotally connected at its first end to or near opposite side edges of foot pedal 39 between hinge 40 and the free end of the pedal, and a pair of lower arms 45, each pivotally connected at its first end to or near opposite side edges of base 38 between hinge 40 and the free end of the base. The second end of the upper arm on each side of the foot pedal assembly is pivotally connected to the second each of the lower arm on the same side of the assembly. A connecting bar 46 extends between the second ends of the connected upper and lower arms in generally parallel relation to hinge 40 in alignment with the pivot connections between the sets of upper and lower arms so that the connecting bar is allowed to rotate about its longitudinal axis. A fourth cable connector 47 is disposed on connecting bar 46, generally centered between its two ends, for connection of the second end of wire 32. The upper and lower arms of the scissor assembly are disposed such that they extend toward hinge 40 at an angle relative to the plane of the foot pedal and the base, respectively, and the angle of separation of pedal 39 from base 38 around hinge 40 is restrained so that the angle between each set of upper and lower arms is less than one hundred eighty degrees. Any convenient means of restraining the degree of separation of the pedal from the base may be used within the scope of the invention. If desired, a latch means, for releasably connecting the pedal in a closed position against the base, may also be provided to facilitate storage of the apparatus. In a variation of this embodiment, scissor assembly 43 may be formed with single upper and lower arms 44 and 45, without a connecting bar 46, and with fourth cable connector 47 connected at the intersection of arms 44 and 45.

As the foot pedal is forced from an open position toward the base, the upper and lower arms of the scissor assembly are moved toward each other and the angle between them is decreased, resulting in movement of the connecting bar toward the hinged ends of the pedal and base. As the connecting bar moves toward hinge 40, the distance between the third cable connector on base 38 and the fourth cable connector on connecting bar 46 is increased. With the second end of tube 31 of the control cable assembly connected to cable connector 42 and the second end of wire 32 connected to cable connector 47 on the connecting bar, depression of pedal 39 toward base 38 pulls wire 32 through the interior of tube 31. With the first end of tube 31 connected to cable connector 38 of lower plate 14 and the first end of wire 32 connected to cable connector 22 of upper plate 13, depression of pedal 38 toward base 39 pulls the upper plate of the pressure applicator assembly to rotate toward the lower plate, bringing aligned knobs 21 toward contact with each other. When the pedal is released, the spring forces reverse the movement of the pedal and base, and of the upper and lower plates, separating knobs 21. It will be understood that the specific configuration of the foot pedal assembly and its components may be varied from that described and shown, so long as the effect of pulling and releasing wire 32 relative to tube 31 is achieved.

In another embodiment of foot pedal 30, the scissor assembly 43 is eliminated, and base 38 includes an arm 48 extending upward from the end of base 38 opposite hinge 40, beyond and above the end of the pedal 39. Third cable connector 42 is disposed at the outer end of arm 48, and the second end 34 of tube 31 is secured in connector 42. Fourth cable connector 47 is disposed at the outer end of pedal 39, below connector 42 at the end of arm 48. The second end 36 of wire 32 is connected to the pedal in connector 47. When pedal 39 is depressed toward base 38, wire 32 is pulled in tube 31 to close the plates of the pressure applicator assembly and bring knobs 21 toward each other. When pedal 39 is released and moves away from base 38, wire 32 is pushed in the interior of tube 31 to separate the plates and knobs of the pressure applicator assembly.

To use the foot pedal embodiment of the invention a user holds the pressure applicator assembly as generally described above, with knobs 21 positioned above and below the acupressure points of the hands, and depresses pedal 39 toward base 38 with one of the user's feet to move the knobs together and apply pressure to those acupressure points. The user can easily adjust the relative position of the hands and knobs by shifting his or her grasp of the pressure applicator assembly, and can easily control the pressure applied to the hands by adjusting the force applied by the user's foot to the pedal. A user is accordingly able to apply acupressure to both hands simultaneously without the assistance of another person, and is able to adjust and control position, strength, and duration of the pressure applied to a degree unprecedented in the prior art.

The foregoing description of preferred embodiments of the apparatus of the invention is intended to be illustrative and not limiting. As noted above, a variety of further structural embodiments of the apparatus may be devised within the scope of the invention, as claimed.

The invention claimed is:

1. An acupressure apparatus for applying pressure to an acupressure point on each of a user's two hands simultaneously, comprising a pressure applicator assembly having an upper plate with a first edge and an opposed second edge, a lower plate with a first edge and an opposed second edge, said upper and lower plates disposed in generally overlying relation and pivotally connected at said first edges, first and second upper knobs connected to said upper plate and fist and second lower knobs connected to said lower plate, with said first upper knob overlying said first lower knob and with said second upper knob overlying said second lower knob such that said first upper and lower knobs and said second upper and lower knobs are brought together when said upper and lower plates are pivoted toward each other;

a generally planar footplate having an upper face and a lower face, said footplate being of sufficient size to receive the balls of the user's feet in side by side relation on said upper face of said footplate; and an elongate flexible cable connected between said upper plate of said pressure applicator assembly and said footplate.

2. The acupressure apparatus of claim 1, wherein said pressure applicator assembly further includes biasing means for biasing said upper and lower plates toward a separated orientation around said pivotal connection.

3. The acupressure apparatus of claim 2, wherein said upper plate and said lower plate are pivotally connected by a hinge, and wherein said biasing means comprises a spring.

4. The acupressure apparatus of claim 3, wherein said spring is integral with said hinge.

5. The acupressure apparatus of claim 1, wherein said pressure applicator assembly further includes a first upper arm and a second upper arm, a first lower arm and a second lower arm, each of said arms having a first end and a second end, said first and second upper arms connected at said first ends thereof to said upper plate and extending outwardly from said second edge of said upper plate, said first and second lower arms connected at said first ends thereof to said lower plate and extending outwardly from said second edge of said lower plate, with said first upper knob connected to said second end of said first upper arm, with said second upper knob connected to said second end of said second upper arm, with said first lower knob connected to said second end of said first lower arm, and with said second lower knob connected to said second end of said second lower knob.

6. The acupressure apparatus of claim 1, wherein said cable is connected to said upper plate of said pressure applicator assembly adjacent to said second edge of said upper plate, said lower plate includes a cable guide disposed adjacent to said second edge of said lower plate, and wherein said cable extends through said cable guide such that said cable is free to move in said cable guide without restriction.

7. The acupressure apparatus of claim 1, wherein said cable has a first end and a second end, said first end of said cable is connected to said upper plate of said pressure applicator assembly, and said foot plate includes a clamp means for releasably connecting said cable to said footplate between said first end of said cable and said second end of said cable, such that the length of the portion of said cable extending between said pressure applicator assembly and said footplate is adjustable.

8. The acupressure apparatus of claim 7, wherein said footplate includes a cable aperture extending through said footplate between said upper face and said lower face, said clamp means is connected to said footplate adjacent to said cable aperture, and said cable extends through said cable aperture and in engagement with said clamp means.

9. The acupressure apparatus of claim 1, wherein said upper knobs are integrally formed with said upper plate, and said lower knobs are integrally formed with said lower plate.

10. The acupressure apparatus of claim 5, wherein said first and second upper arms are integrally formed with said upper plate, and said first and second lower arms are integrally formed with said lower plate.

11. The acupressure apparatus of claim 10, wherein said first upper knob is integrally formed with said first upper arm, said second upper knob is integrally formed with said second upper arm, said first lower knob is integrally formed with said first lower arm, and said second lower knob is integrally formed with said second lower arm.

12. An acupressure apparatus for applying pressure to an acupressure point on each of a user's two hands simultaneously, comprising a pressure applicator assembly having an upper plate with a first edge and an opposed second edge, a lower plate with a first edge and an opposed second edge, said upper and lower plates disposed in generally, overlying relation and pivotally connected at said first edges, biasing means for biasing said upper plate and said lower plate away from each other about said pivotal connection, first and second upper knobs connected to said upper plate and fist and second lower knobs connected to said lower plate, with said first upper knob overlying said first lower knob and with said second upper knob overlying said second lower knob such that said first upper and lower knobs and said second upper and lower knobs are brought together when said upper and lower plates are pivoted toward each other;

a foot pedal assembly having a base and a foot pedal pivotally connected to said base so as to allow said foot pedal to rotate toward and away from a generally parallel orientation relative to said base about said pivotal connection; and an elongate flexible cable assembly having an outer tube with first and second ends and a hollow interior and an inner wire with first and second ends, said wire extending through said interior of said tube and longitudinally movable within said tube, with said first end of said wire extending beyond said first end of said tube and said second end of said wire extending beyond said second end of said tube, said first end of said tube connected to said lower plate of said pressure applicator assembly adjacent to said outer edge thereof, said first end of said wire connected to said upper plate of said pressure applicator assembly adjacent to said second edge thereof, said second end of said tube connected to said base of said foot pedal assembly in fixed relation relative thereto, and said second end of said wire operatively connected to said foot pedal of said foot pedal assembly, such that movement of said foot pedal relative to said base causes longitudinal movement of said wire relative to said tube, thereby causing movement of said upper plate of said pressure applicator assembly relative to said lower plate of said pressure applicator assembly.

13. The acupressure apparatus of claim 12, wherein said foot pedal assembly further includes a biasing means for biasing said foot pedal away from said base.

14. The acupressure apparatus of claim 12, wherein said biasing means of said pressure applicator assembly comprises a spring.

15. The acupressure apparatus of claim 13, wherein said biasing means of said foot pedal assembly comprises a spring.

16. The acupressure apparatus of claim 12, wherein said foot pedal assembly includes a scissor assembly connected between said base and said foot pedal, said scissor assembly having an upper arm pivotally connected at one end to said foot pedal, a lower arm pivotally connected at one end to said base, with said upper arm and said power arm pivotally connected to each other, and wherein said second end of said wire is connected to said upper and lower arms of said foot pedal assembly at said pivotal connection between said arms.

17. The acupressure apparatus of claim 12, wherein said foot pedal assembly includes an arm connected to and extending upwardly from said base, said second end of said tube is connected to said arm, and said second end of said wire is connected to said foot pedal.

* * * * *